US007019653B2

(12) United States Patent
Benedict

(10) Patent No.: US 7,019,653 B2
(45) Date of Patent: Mar. 28, 2006

(54) SYSTEM FOR ALERTING A VEHICLE DRIVER

(76) Inventor: Robert Lorin Benedict, 6712 Cardinal Dr. S., St. Petersburg, FL (US) 33707

( * ) Notice: Subject to any disclaimer, the term of this patent is extended or adjusted under 35 U.S.C. 154(b) by 0 days.

(21) Appl. No.: 10/725,161

(22) Filed: Dec. 1, 2003

(65) Prior Publication Data

US 2004/0113800 A1 Jun. 17, 2004

Related U.S. Application Data

(63) Continuation-in-part of application No. 10/139,789, filed on May 7, 2002, now abandoned.

(51) Int. Cl.
*G08B 23/00* (2006.01)

(52) U.S. Cl. ..... 340/576; 180/272; 340/439

(58) Field of Classification Search ..... 340/576, 340/575, 439; 180/272
See application file for complete search history.

(56) References Cited

U.S. PATENT DOCUMENTS

| | | | | |
|---|---|---|---|---|
| 3,106,981 | A | | 10/1963 | Chakiris |
| 3,794,969 | A | | 2/1974 | Klopfenstein et al. |
| 4,278,969 | A | * | 7/1981 | Woods ..... 340/576 |
| 5,642,093 | A | | 6/1997 | Kinoshita et al. |

* cited by examiner

*Primary Examiner*—Thomas Mullen

(74) *Attorney, Agent, or Firm*—Larson & Larson, PA; Herbert W. Larson

(57) ABSTRACT

A graduated optic tape is mounted on a steering wheel component and is read by an optical sensor. The sensor is electrically connected to a first and second timer and a buzzer for alerting a driver when the steering wheel in a moving vehicle is not turned for five to ten seconds. A DC power supply provides electrical energy. The system is connected to the vehicle brake light so that the buzzer does not sound when the brake is engaged.

14 Claims, 2 Drawing Sheets

SYSTEM FOR ALERTING A VEHICLE DRIVER

PRIOR APPLICATION

This application is a continuation-in-part from application Ser. No. 10/139,789, filed May 7, 2002 now abandoned.

BACKGROUND OF THE INVENTION

The present invention relates to a system for alerting a driver of a motor vehicle. More particularly, it refers to a system for detecting a driver's failure to move the steering wheel in a normal manner such as when the driver is drowsy and provides a warning to alert the driver.

It is well known from U.S. Pat. Nos. 3,106,981 and 3,794,969 that the normal vehicle driver moves the steering wheel at about one quarter of an inch or two degrees every few seconds. The failure to move the wheel within seven seconds is an indication that the driver is drowsy or has fallen asleep. This condition frequently results in dangerous accidents seriously injuring or killing the driver and possibly others. While the aforementioned patents provide a means to alert the driver, there are practical problems in implementing these prior art systems. A practical after market system for alerting a driver when the driver is not operating the motor vehicle in a normal manner is needed.

SUMMARY OF THE INVENTION

The present invention provides a driver alert system that can be easily mounted to a vehicle. A graduated optic tape is mounted on a steering component and is read by an optic sensor. If the steering wheel in a moving vehicle is not moved for five to ten seconds as set in a first timer, the system alerts the driver with a buzzer activated for at least a second by a second timer. The system is operated by a D.C. circuit connected to the brake light so that the system will not operate when the brake light is on.

BRIEF DESCRIPTION OF THE DRAWINGS

The invention is best understood by those having ordinary skill in the art by reference to the following detailed description when considered in conjunction with the accompanying drawings in which.

DETAILED DESCRIPTION OF THE INVENTION

Figure 1:
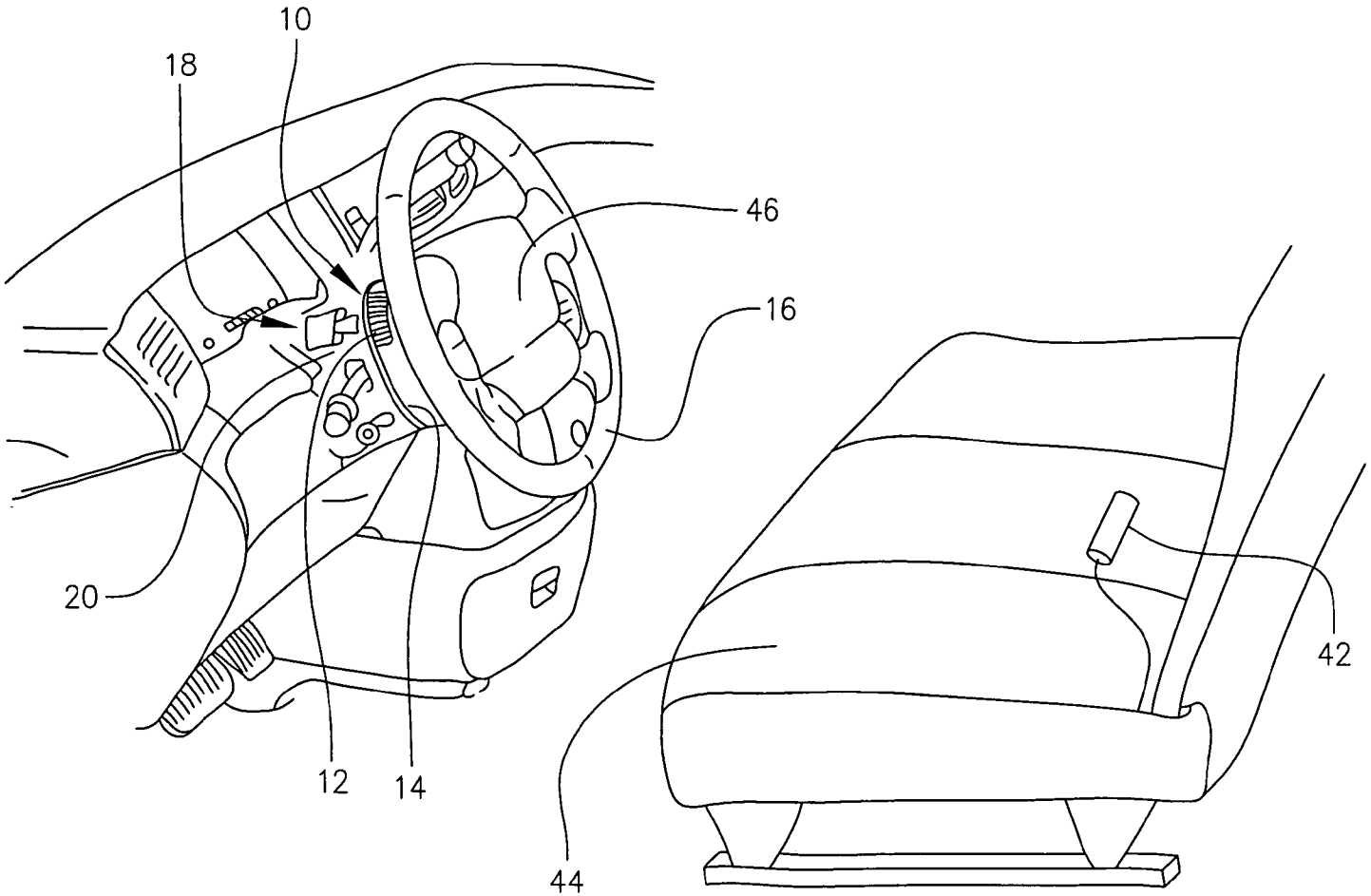
FIG. 1 is a perspective view of a vehicle driver station showing the location of the alerting system components.

Throughout the following detailed description, the same reference numerals refer to the same elements in all figures.

Figure 2:
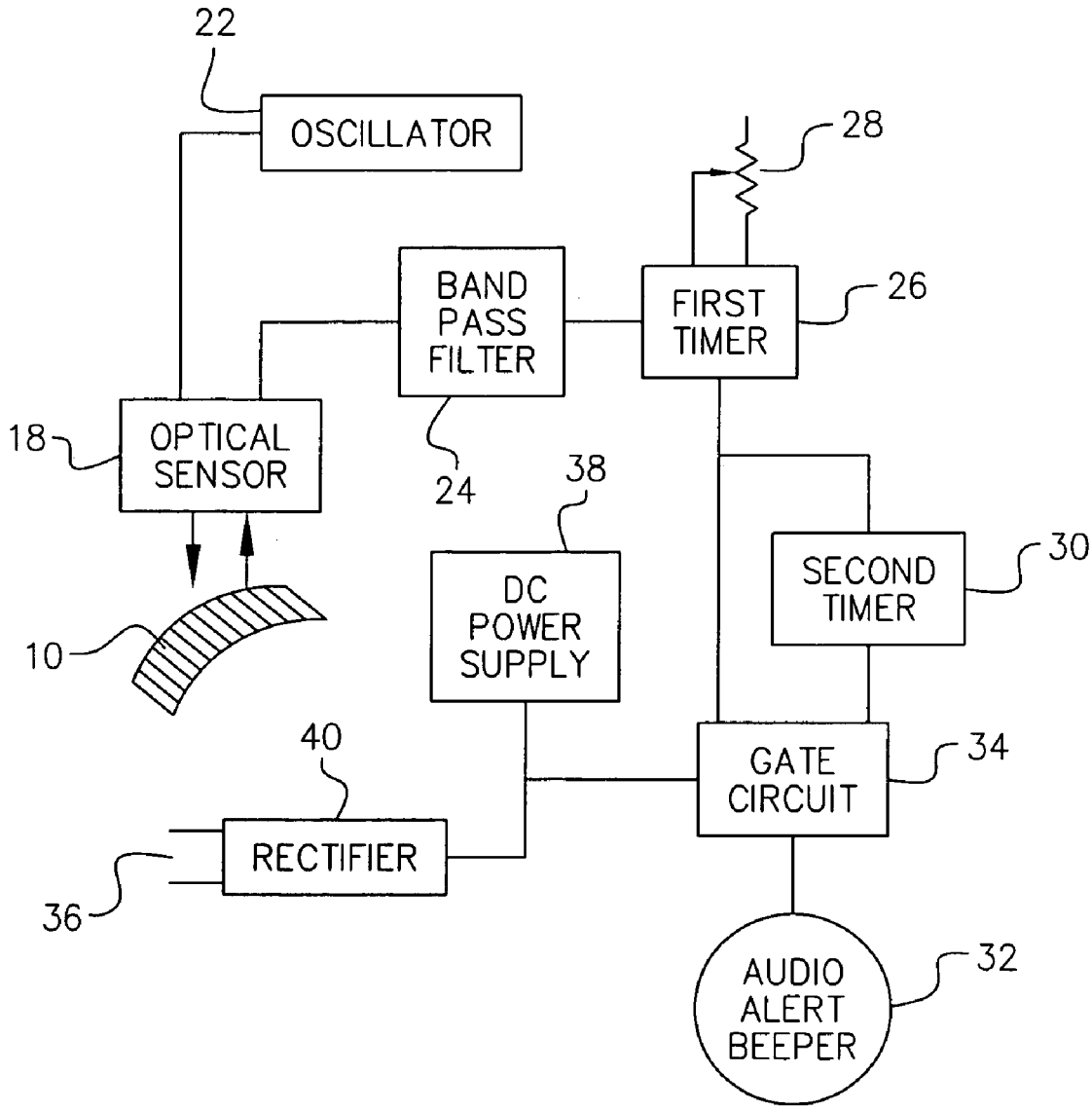
FIG. 2 is a schematic of the driver alerting system electrical elements.

Referring to FIGS. 1–2, a strip of reflective tape 10 with graduated lines 12 is affixed to the hub 14 of a steering wheel 16 by glue. An optical sensor motion detector 18 is mounted on the steering column 20 by glue. An oscillator 22 modulates the emission from the optic sensor to a frequency between 5 $KH_z$ and 10 $KH_z$. The sensor 18 output passes through band-pass filter 24 which passes only the emitter's modulated frequency. This eliminates the effects covered by ambient light changes, sunlight or passing under street lights at night.

The pulses emanating from filter 24 are used to reset first timer 26. The timer 26 is manually adjustable between five to ten seconds by control 28. The timer 26 outputs a signal when the optical sensor 18 does not sense movement of the steering wheel 16 for the prescribed period of time set by control 28. The timer 26 output continues until steering wheel 16 is moved as determined by sensor 18. Movement of steering wheel 16 resets timer 26. The second timer 30 provides a minimum output of one second regardless of the output duration of first timer 26. This assures that audio alert buzzer or beeper 32 mounted inside the vehicle will sound a minimum of one second. A gate circuit 34 controls the audio buzzer 32 and allows it to sound only when the brake is not applied. The gate 34 is controlled by sensing voltage across the brake light switch 36. Voltage across the brake light switch 36 closes the switch and prevents current from activating beeper 32.

When a driver fails to move the steering wheel 16 for five to ten seconds as set in timer 26, by the timer adjustment control 28, an audio buzzer 32 will sound. The buzzer 32 will not sound when stopped at a traffic light because the circuit inhibits the buzzer when it senses the brake light 36 through rectifier 40. The circuit is run by the vehicle power supply or an alternate DC power supply 38.

The alerting means can be a buzzer 32 or a vibrator 42 located in the driver's seat 44. In addition, the circuit could be connected to the vehicle horn 46 to cause it to sound instead of buzzer 32, This system for alerting drivers can be easily installed as an after market item. The optical sensor 18 and reflective tape 10 are merely glued to vehicle components and the electrical connection to the brake light switch 36 is usually found under the vehicle dash board.

A substantially equivalent functional system can be produced by substituting substantially equivalent elements for the above described elements to produce substantially the same results in substantially the same way.

The invention claimed is:

1. A system for detecting a failure of a driver of a moving motor vehicle to move a steering wheel in a normal manner, the system comprising:

a graduated optic tape mounted on a hub of a steering wheel with an adjacent optical sensor reading the optic tape, the optical sensor mounted on a steering wheel column;

the optical sensor electrically connected to a first and second timer, a means for alerting the driver, a DC power supply and a brake light switch; and the optical sensor sending a signal to the means for alerting the driver if the steering wheel does not move for a prescribed period of seconds while the motor vehicle is moving.

2. The system for detecting failure of a driver of a moving motor vehicle to move a steering wheel in a normal manner according to claim 1 wherein the first timer is manually adjustable by a controller to output a signal when the optical sensor does not sense movement, of the steering wheel for a period to five to ten seconds.

3. The system for detecting a failure of a driver of a moving motor vehicle to move a steering wheel in a normal manner according to claim 1 wherein the second timer provides a minimum electrical output to an alarm device of one second regardless of the output duration of the first timer.

4. The system for detecting a failure of a driver of a moving motor vehicle to move a steering wheel in a normal manner according to claim 1 wherein the means for alerting the driver is a vibrator in a vehicle seat underneath the driver.

5. The system for detecting a failure of a driver of a moving motor vehicle to move a steering wheel in a normal manner according to claim 1 wherein the first timer is reset by an electrical pulse emanating from a band-pass filter when the wheel turns.

6. The system for detecting a failure of a driver of a moving motor vehicle to move a steering wheel in a normal manner according to claim 1 wherein the means for alerting the driver is a buzzer.

7. An after market system for alerting a driver of a moving vehicle when a steering wheel operated by the driver fails to move for a prescribed period of time, the system comprising:

a graduated optically readable tape mounted on a movable component of the steering wheel;

an optical sensor mounted adjacent the optically readable tape and positioned to read the optically readable tape;

the optical sensor sending an electrical signal to a first and second timer;

the system sending an electrical signal to a means for alerting the driver if the steering wheel does not move for the prescribed period of time;

the first timer connected electrically to a controller for inputting a signal for a prescribed period of time; and the second timer sending an electrical signal to the means for alerting the driver, provided a brake light switch connected to the system is not closed.

8. The system according to claim 7 wherein an emission from the optical sensor is modulated by an oscillator at a frequency between 5 $KH_z$ and 10 $KH_z$.

9. The system according to claim 7 wherein a band-pass filter in the system passes only the modulated frequency from the oscillator to the first timer.

10. The system according to claim 9 wherein the first timer is reset by an electrical pulse emanating from the band-pass filter when the steering wheel moves.

11. The system according to claim 7 wherein the prescribed period of time inputted into the first timer is five to ten seconds.

12. The system according to claim 7 wherein the means for alerting the driver is a buzzer mounted inside the vehicle.

13. The system according to claim 7 wherein the means for alerting the driver is a vibrator mounted in a seat under the driver.

14. The system according to claim 7 wherein the optical sensor electrical signal is in a D.C. circuit.

* * * * *